United States Patent [19]

Petito et al.

[11] 4,435,668

[45] Mar. 6, 1984

[54] METHOD OF MAKING RUGGED VIDICON

[75] Inventors: Ferdinand C. Petito, Alexandria; Gerald Klauber, Fredericksburg, both of Va.

[73] Assignee: The United States of America as represented by the Secretary of the Army, Washington, D.C.

[21] Appl. No.: 335,927

[22] Filed: Dec. 30, 1981

[51] Int. Cl.[3] ..... H01J 31/49

[52] U.S. Cl. ..... 313/388; 445/35; 445/33

[58] Field of Search ..... 445/29, 33, 35, 36, 445/44; 228/115; 313/388

[56] References Cited

U.S. PATENT DOCUMENTS

| | | | |
|---|---|---|---|
| 3,873,872 | 3/1975 | Conklin et al. | 313/388 |
| 3,993,907 | 11/1976 | Veron | 313/388 |
| 3,999,698 | 12/1976 | Conklin | 445/29 |
| 4,030,789 | 6/1977 | Schampers et al. | 445/44 |
| 4,104,771 | 8/1978 | Clark et al. | 427/74 |

*Primary Examiner*—Kenneth J. Ramsey
*Assistant Examiner*—Kurt Rowan
*Attorney, Agent, or Firm*—Robert P. Gibson; Milton W. Lee; Aubrey J. Dunn

[57] ABSTRACT

A rugged retina is constructed for a vidicon having a rugged electron gun and other electrodes. The retina is prepared by mounting it between two thin flexible metal or metalized rings with a high viscosity liquid electrode between one of the rings and the retina. This prepared assembly is glued together and onto the vidicon faceplate with a pliant adhesive.

2 Claims, 2 Drawing Figures

METHOD OF MAKING RUGGED VIDICON

The invention described herein may be manufactured, used, and licensed by the U.S. Government for governmental purposes without the payment of any royalties thereon.

BACKGROUND OF THE INVENTION

This invention is in the field of television camera tubes. In particular, it is concerned with those tubes for employing pyroelectric retinas for use at infrared wavelengths. Both image intensification and thermal (infrared) imaging systems are of interest to those having need for vision under very low or no visible light conditions. Several such systems are now well developed as the result of military interest, with the primary focus falling on thermal systems. A typical thermal system now in use is the so-called FLIR (forward looking infrared). This system uses one or more cryogenically cooled infrared detectors with mechanically moved optical elements for scanning a field of view. Although good results may be obtained from a FLIR and it is fairly rugged, it does have the disadvantages as to weight, noise, and relatively high power consumption compared to a standard television system using a camera tube. The development of the infrared pyroelectric vidicon has given an alternative to FLIR, but this vidicon has the disadvantage of being relatively fragile to shock compared to FLIR. The fragility resides in the retina and the electron gun of the vidicon. Since ruggedized electron guns are known, the instant invention is particularly directed to steps for making a rugged retina for a pyroelectric vidicon.

SUMMARY OF THE INVENTION

This invention is a method of making a rugged infrared vidicon, and is primarily directed at the method steps required for making a rugged pyroelectric retina for such a vidicon. The retina is assembled into a shock-resistant mount by placing it between two relatively thin flexible rings, with a high viscosity liquid electrode between one of the rings and the retina. This assembly is held onto the vidicon faceplate with a pliant adhesive.

DESCRIPTION OF THE PREFERRED EMBODIMENT

Figure 1:
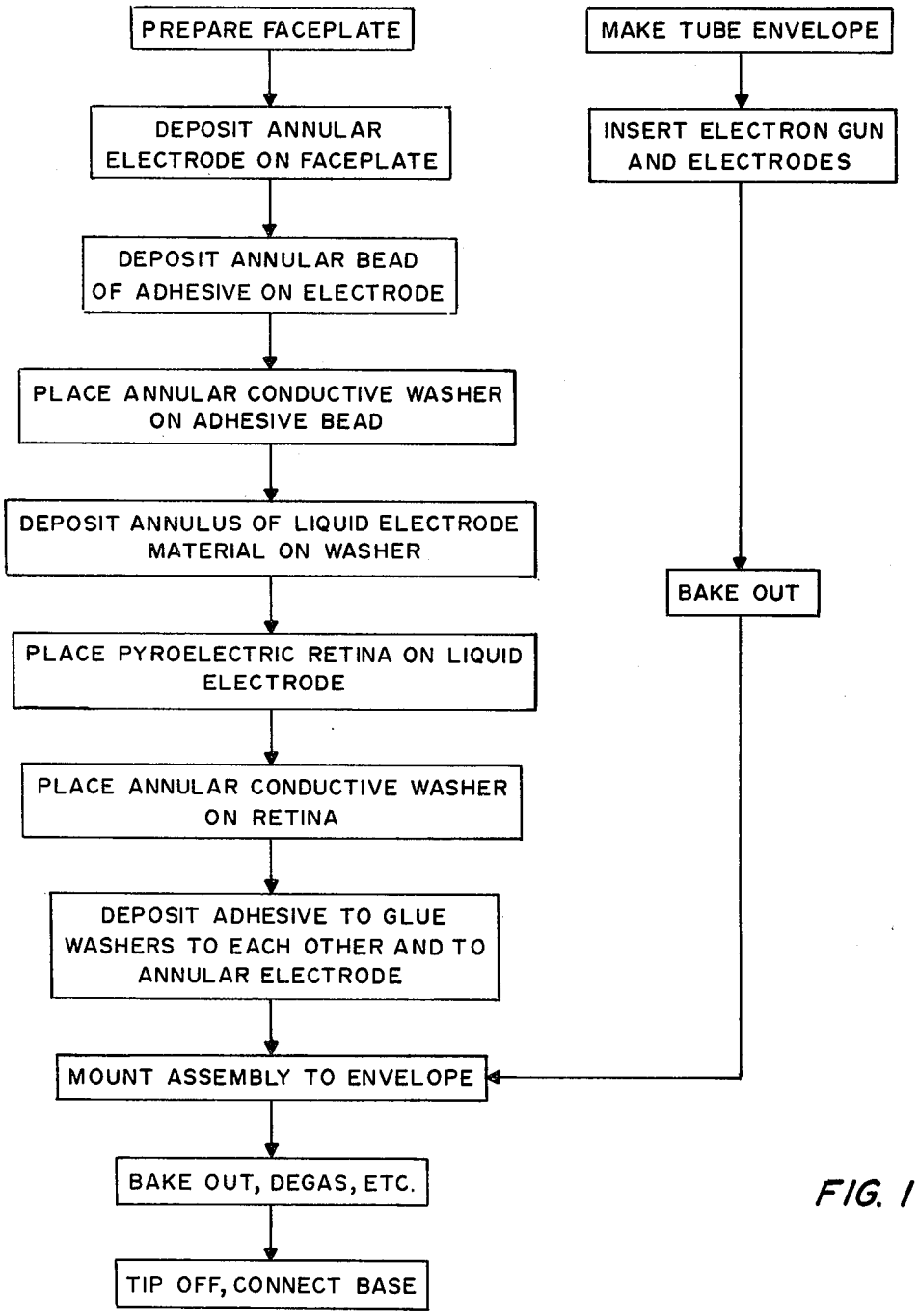
FIG. 1 is a flow chart of the inventive method.

The invention may be best understood when this description is taken in conjunction with the drawings, in which the flow chart of FIG. 1 shows the main steps of the method. The method begins with the steps of preparing a faceplate of glass or other material, depending upon whether visible or infrared light is to be detected. In any event, an annular electrode is deposited on one side of the faceplate, as by evaporation or spattering of a metal through a mask on the plate. An annular bead of adhesive is then applied to the annular electrode and atop this bead, a first thin annular conductive washer. On the washer an annalus of liquid electrode is deposited. The pyroelectric retina is placed on the liquid electrode and a second thin annular conductive washer is placed on top of the retina. An adhesive is then deposited to glue the washers to each other and to the annular electrode on the faceplate. The faceplate-retina assembly is thus ready for mounting in the vidicon tube envelope. This envelope is prepared in the usual manner, a rugged electron gun (known in the art) is inserted, and the other electrodes of the tube are added, all in the usual manner. This tube assembly is then baked out or degassed as well known. The faceplate-retina assembly is mounted to the prepared tube assembly, and the usual steps of baking-out, degassing, firing getters, etc. are performed. When these steps are completed, the tube is tipped-off and the base with its connecting pins is added.

Figure 2:
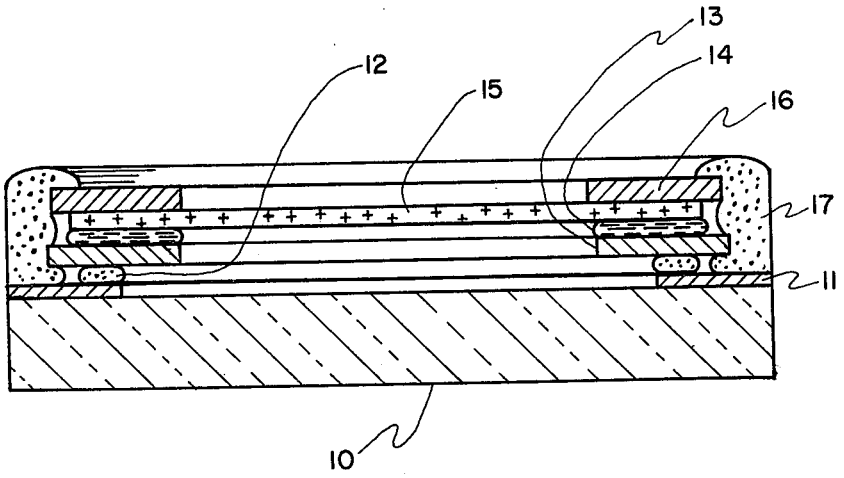
FIG. 2 is a cross-sectional view of a vidicon retina-faceplate combination made in accordance with the invention.

The faceplate-retina is shown in section in FIG. 2, wherein reference numeral 10 designates the transparent faceplate, with annular electrode 11 thereon. Atop 11 is annular bead 12 of adhesive, with first conductive washer 13 thereon. Liquid electrode 14 is on 13 and the pyroelectric retina 15 lies on 14. Second conductive washer 16 is atop retina 15. Washers 13 and 16 are held together and to electrode 11 by adhesive 17. If desired, adhesive 17 may be conductive, to provide electrical connection to retina 15, or other means (not shown) may be employed for this connection. Washers 13 and 16 may be metal or may be metal coated insulating material.

Typical dimensions and materials fo the faceplate-retina are as follows: diameter of 10: one inch; diameters of 13 and 16: three-quarter inch; diameter of 15: five-eights inch; the thicknesses of 10, 11, 12, 13, 14, 15, and 16 are respectively as follows: one-eight inch, 0.001 inch, one-sixteenth inch, 0.005–0.006 inch, one-sixteenth inch, 50 $\mu$m, and 0.005-0.006 inch. The inside diameters of 13 and 16 are about one-half inch, and the preferred material is mica with a thin evaporated layer of Nichrome thereon. The liquid of electrode 14 is metal alloy of low melting temperature (below normal room temperature), such as an eutectic gallium alloy. U.S. Pat. No. 4,030,789 teaches such alloys. Annular adhesive 12 is gallium and adhesive 17 is an indium alloy.

We claim:

1. A method of making a rugged vidicon including the steps of:

preparing an envelope for such vidicon;

inserting grids and a rugged electron gun in said envelope;

making a retina for said vidicon wherein this step includes the steps of:

preparing a transparent faceplate;

depositing an annular electrode on one side of said faceplate;

depositing an annular bead of adhesive on said annular electrode;

placing a thin annular conductive washer on said bead;

depositing an annulus of liquid electrode material on said washer;

placing a pyroelectric retina on said liquid electrode;

placing a thin annular conductive washer on said retina;

depositing an adhesive to join said washers to each other and to said annular electrode;

mounting the faceplate to the front of said envelope with said retina inside;

pumping a vacuum in said envelope, degassing, getting and tipping off said envelope.

2. The product as produced by the method of claim 1.

* * * * *